US007337848B2

(12) United States Patent
Fraser et al.

(10) Patent No.: US 7,337,848 B2
(45) Date of Patent: Mar. 4, 2008

(54) PRELOADED RISER COUPLING SYSTEM

(75) Inventors: Thomas A. Fraser, Spring, TX (US); Charles E. Jennings, Houston, TX (US); John E. Nelson, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 11/508,689

(22) Filed: Aug. 23, 2006

(65) Prior Publication Data

US 2007/0044975 A1 Mar. 1, 2007

Related U.S. Application Data

(60) Provisional application No. 60/751,185, filed on Dec. 16, 2005, provisional application No. 60/751,187, filed on Dec. 16, 2005, provisional application No. 60/710,417, filed on Aug. 23, 2005.

(51) Int. Cl.
*E21B 29/12* (2006.01)

(52) U.S. Cl. ..... 166/345; 166/359; 166/344

(58) Field of Classification Search ..... 166/345, 166/350, 359, 367, 344, 348
See application file for complete search history.

(56) References Cited

U.S. PATENT DOCUMENTS 3,827,728 A * 8/1974 Hynes ..... 285/90
4,433,859 A 2/1984 Driver et al.
4,491,346 A * 1/1985 Walker ..... 285/18
4,540,053 A * 9/1985 Baugh et al. ..... 166/348
4,647,254 A * 3/1987 Baugh et al. ..... 405/169
4,653,778 A * 3/1987 Alandy ..... 285/18
4,902,044 A 2/1990 Williams et al.
5,255,743 A * 10/1993 Adam et al. ..... 166/345
5,433,274 A 7/1995 Graff et al.
6,035,938 A 3/2000 Watkins
6,129,149 A 10/2000 Beall
6,138,762 A * 10/2000 Sweeney et al. ..... 166/359
6,237,964 B1 * 5/2001 ØStergaard ..... 285/85
6,293,343 B1 * 9/2001 Pallini et al. ..... 166/345
6,328,343 B1 12/2001 Hosie et al.

(Continued)

OTHER PUBLICATIONS 1980-1981, Regan Offshore International, Inc., Torrance, California, cover page, index page, page showing Type FCF Buoyant Riser (total of 3 pages).
Vetco Gray, Drawing No. H113177, dated Apr. 30, 1996 of Connector-Wellhead.
Vetco General Catalog 1986-1987, Combustion Engineering, illustrations of Marine Riser Connectors and Connector Features.
Hughes Offshore Catalog 1986-1987, FC-8, FD-8 Drilling Riser.

*Primary Examiner*—Thomas A Beach
(74) *Attorney, Agent, or Firm*—Bracewell & Giuliani LLP

(57) ABSTRACT

An offshore riser system has riser joints, each having a pin and a box. The pin has an external grooved profile that is engaged by a locking element carried by the box of another riser joint. An actuating ring engages with the locking element to move it into the locked position. A retractable spider supports the string of riser while the new joint is being made up. A makeup tool on the riser deploying floor moves the ring relative to the locking element, causing the locking element to move to the locked position.

20 Claims, 14 Drawing Sheets

U.S. PATENT DOCUMENTS

| | | | | |
|---|---|---|---|---|
| 6,330,918 | B1 | 12/2001 | Hosie et al. | |
| 6,540,024 | B2 * | 4/2003 | Pallini et al. | 166/348 |
| 2001/0045286 | A1 * | 11/2001 | Pallini et al. | 166/345 |
| 2002/0009336 | A1 * | 1/2002 | Munk et al. | 405/224.2 |
| 2003/0141718 | A1 * | 7/2003 | Bilderbeek | 285/348 |
| 2006/0196673 | A1 * | 9/2006 | Pallini et al. | 166/368 |

* cited by examiner

PRELOADED RISER COUPLING SYSTEM

CROSS-REFERENCE TO RELATED APPLICATIONS

This invention claims the benefit of provisional application Ser. No. 60/710,417, filed Aug. 23, 2005, provisional application Ser. No. 60/751,185, filed Dec. 16, 2005, and provisional application Ser. No. 60/751,187, filed Dec. 16, 2005.

FIELD OF THE INVENTION

This invention relates in general to offshore well risers and in particular to a system for connecting joints of riser together.

BACKGROUND OF THE INVENTION

In offshore drilling operations in deep water, the operator will perform drilling operations through a drilling riser. The drilling riser extends between the subsea wellhead assembly at the seafloor and the drilling vessel. The drilling riser is made up of a number of individual joints or sections. These sections are secured to each other and run from a riser deploying floor. The drilling riser also normally has a number of auxiliary conduits that extend around the main central pipe. The auxiliary conduits supply hydraulic fluid pressure to the subsea blowout preventer and lower marine riser package. A recent type of drilling riser does not require auxiliary lines spaced around it. That type of drilling riser is built to withstand high pressure, and the blowout preventer is located on the drilling rig.

The central pipe of a drilling riser joint has a pin member on one end and a box member on the other end. The pin of one riser joint stabs into the box of the next riser joint. In one type of riser joint, flanges extend outward from the pin and box. The operator connects the flanges together with a number of bolts spaced around the circumference of the coupling. In another type of riser, individual segments or locking segments are spaced around the circumference of the box. A screw is connected to each locking segment. Rotating the screw causes the locking segment to advance into engagement with a profile formed on the end of a pin.

In these systems, a riser spider or support on a riser deploying floor moves between a retracted position into an engaged position to support previously made-up riser joints while the new riser joint is being stabbed into engagement with the string. Wave movement can cause the vessel to be moving upward and downward relative to the riser.

In both types of risers, workers use wrenches to make up the bolts or screws. Personnel employed to secure the screws or the bolts are exposed to a risk of injury. Also, making up the individual bolts is time consuming. Often when moving the drilling rig moving the drilling rig from one location to another, the riser has to be pulled and stored. In very deep water, pulling and rerunning the riser is very expensive. At least one automated system is shown in U.S. Pat. No. 6,330,918 for making up riser locking segment screws.

SUMMARY

The offshore riser system includes a riser deploying floor having an opening. Each joint of the riser has a box on one end and a pin on the other end. The pin has an external grooved profile, and a locking element is carried by the box for movement from an unlocked position into a locked position in engagement with the profile of the pin. A ring is in engagement with the locking element.

A retractable spider is supported by the floor at the opening for supporting a first riser joint in the opening while the end of a second riser joint is stabbed into engagement with the end of the first riser joint. A make-up tool is supported by the floor at the opening for moving the ring relative to the locking element, causing the locking element to move to the locked position to connect the first and second riser joints together. Preferably, the make-up tool has a plurality of units mounted around the opening in the riser deploying floor In one embodiment, the make-up tool moves the ring axially when moving the ring to the locked position. In another embodiment, the make-up tool rotates the ring to cause the locking element to move to the locked position.

Each unit of the make-up tool has an engaging member and a positioning device for moving the engaging member inward from a retracted position to an engaged position in engagement with the ring. In one embodiment, an actuating device moves the engaging member axially to move the ring axially from the unlocked to the locked position.

DETAILED DESCRIPTION OF THE INVENTION

Figure 1:
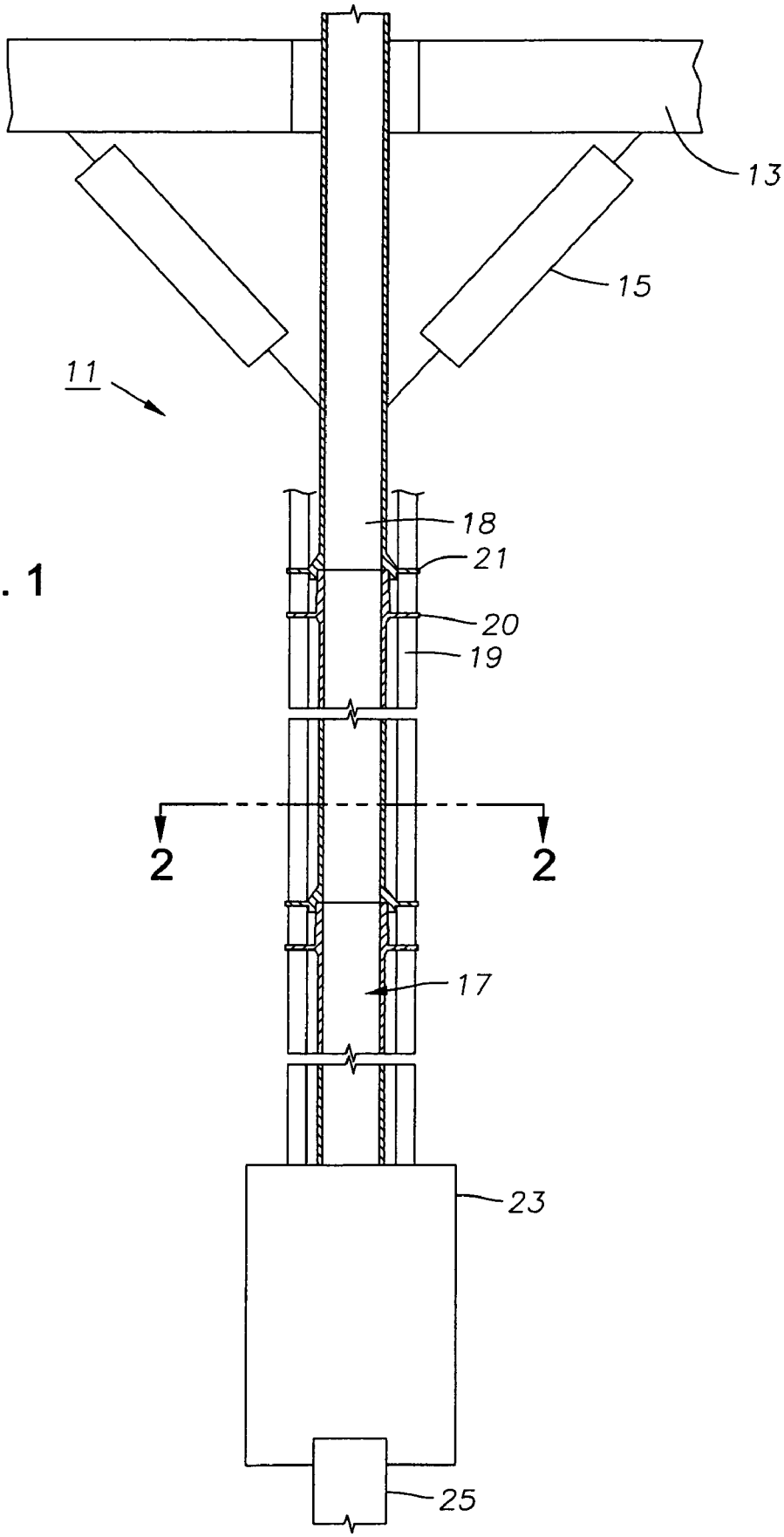
FIG. 1 is a schematic view illustrating a riser constructed in accordance with this invention.

Referring to FIG. 1, a drilling riser 11 is schematically shown extending from a floating platform 13 for drilling offshore wells. Riser 11 is supported in tension by tensioners 15 suspended from platform 13. Riser 11 is made up of a plurality of riser joints 17, each approximately 40-65 feet in length. Each riser joint 17 has a central tubular member 18 of a desired diameter. Typically, several auxiliary lines 19 are spaced around the exterior of central pipe 18 for supplying fluids to the subsea blowout preventer for various drilling and completion operations. Auxiliary lines 19 are considerably smaller in diameter than central pipe 18. If a surface blowout preventer is used, auxiliary lines 19 might be omitted.

Each riser joint 17 has an upper flange 20 adjacent its upper end and a lower flange 21 adjacent its lower end. Auxiliary lines 19 extend through and are supported by holes provided in each flange 20, 21. A lower marine riser package 23 is shown schematically at the lower end of riser 11. Lower marine riser package 23 includes a number of hydraulically actuated components, such as a blowout preventer, pipe rams, and a quick disconnect mechanism. Lower marine riser package 23 also has a hydraulic connector on its lower end that connects it to a subsea wellhead assembly 25.

Figure 3:
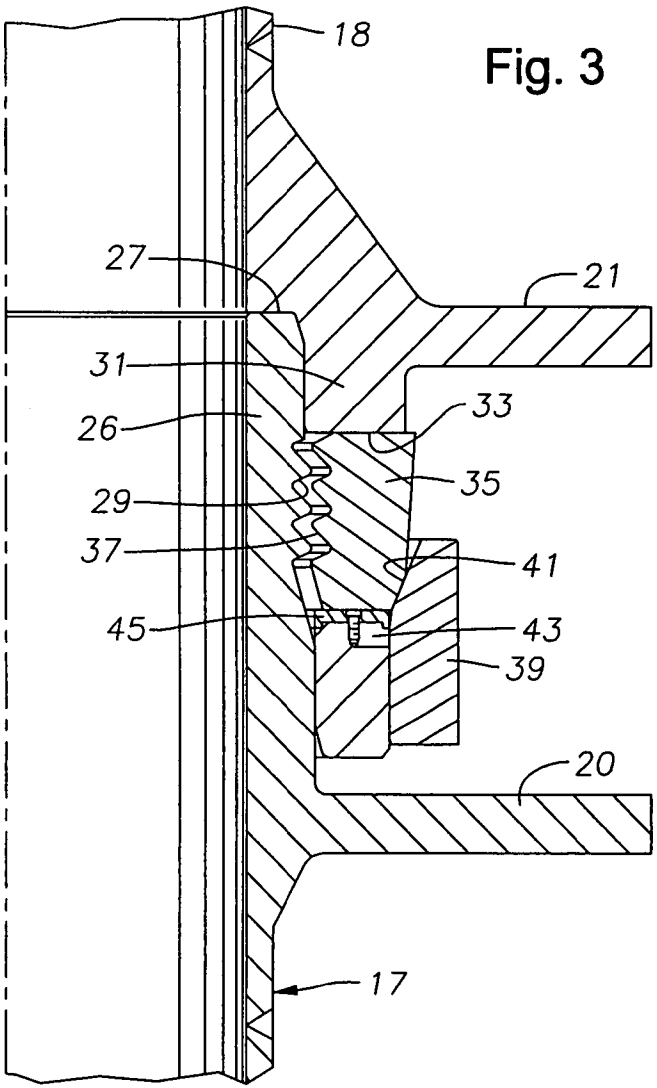
FIG. 3 is a sectional view of the riser coupling of FIG. 2, taken along the line 3-3 of FIG. 2, but shown in a disconnected position.
Figure 2:
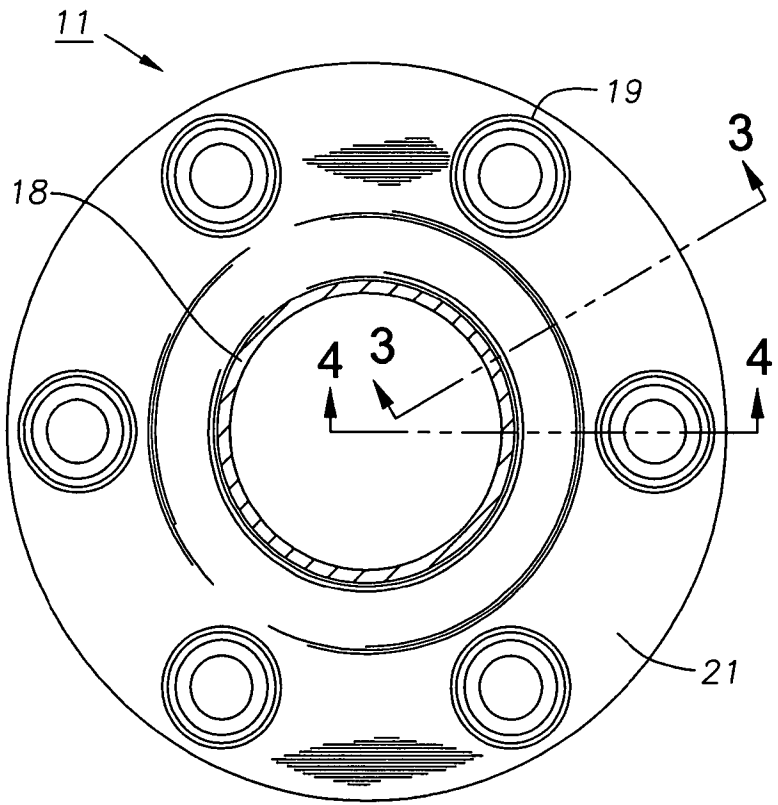
FIG. 2 is a sectional view of a coupling of the riser of FIG. 1, taken along the line 2-2 of FIG. 1.

Referring to FIG. 3, a mandrel or pin 26 is welded to or formed on one end of each central pipe 18, which is shown as the upper end in this example. Pin 26 has a rim 27 on its upper end, and upper flange 20 is welded to or integrally formed with pin 26. An external profile 29 is located on the exterior of pin 26 just below upper rim 27. External profile 29 may have a variety of shapes, but will comprise at least one groove; in this embodiment it comprises a number of parallel circumferentially extending grooves.

A socket or box 31 is welded to or formed on the opposite end of each central pipe 18. Box 31 extends below lower flange 21, and during make up, slides over pin 26 and lands on upper rim 27. Seals (not shown) will seal box 31 to pin 26. Pin 26 and box 31 both have larger cross-sectional thicknesses than central pipe 18.

Box 31 has a plurality of circumferentially spaced-apart windows 33 formed in its sidewall. Each window 33 is generally rectangular in this embodiment. A locking segment 35 is carried within each window 33 for moving between a retracted position, shown in FIG. 3, and a locked position, shown in FIG. 6. Each locking segment 35 has grooves 37 on its inner side that mate with external profile 29 when locked.

An annular cam ring 39 encircles box 31 and has a tapered surface 41 on its upper side that engages a mating tapered surface on the exterior of each locking segment 35. In this example, moving cam ring 39 from the lower position shown in FIG. 3 to the upper position shown in FIG. 6 causes locking segments 35 to move inward to the locked position. The dimensions of box 31 and pin 26 are selected so that when box 31 lands on upper rim 27, grooves 37 will be axially misaligned with profile 29 a small amount. When cam ring 39 pushes locking segments 35 into engagement with profile 29, the wedging action of locking segments 35 engaging profile 29 will exert a downward force on box 31, creating a preloaded connection between pin 26 and box 35.

Cam ring tapered surface 41 forms a locking taper with locking segments 35, preventing cam ring 39 from sliding downward unless significant force is applied. However, as a safety feature, preferably several spring-loaded detents 43 (only one shown) are spaced around the exterior of box 31 below locking segments 35. Detents 43 will snap under cam ring 39 when the connection is made up. Also, preferably a wear plate 45 is located on the lower edge of each window 33.

Figure 5:
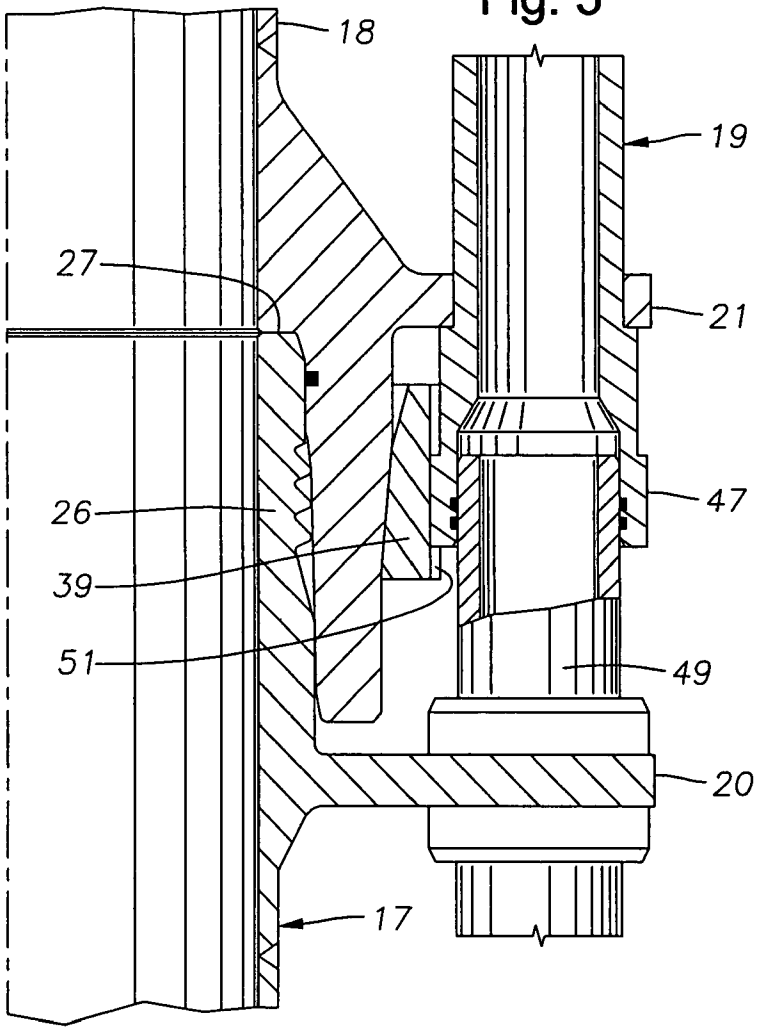
FIG. 5 is a sectional view of the riser coupling similar to FIG. 4, but showing the riser coupling in a connected position.
Figure 4:
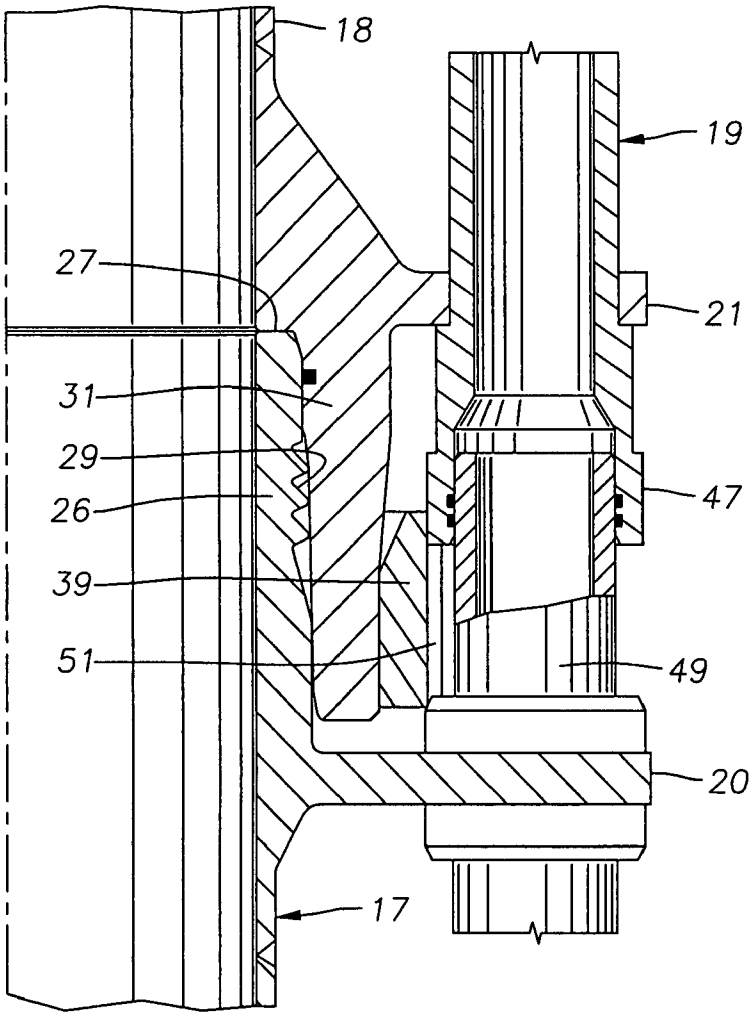
FIG. 4 is a sectional view of the riser coupling of FIG. 2, taken along the line 4-4 of FIG. 2, but shown in a disconnected position.

According to FIGS. 4 and 5, each auxiliary line 19 has a lower end 47 that slides sealingly over an upper end 49 of the auxiliary line 19 of the next lower riser joint 17. Lower and upper ends 47, 49 could be reversed. Recesses 51 may be located on the exterior of cam ring 39 to avoid contact with auxiliary line ends 47, 49. As can be seen by comparing FIGS. 4 and 5, moving can ring 39 from the lower position in FIG. 4 to the upper position of FIG. 5 does not affect the engagement of auxiliary line lower and upper ends 47, 49.

A variety of different tools could be employed for moving cam ring 39 from the lower position to the upper position and vice versa. One such handling tool 53 is shown in FIGS. 6-9. Handling tool 53 is supported on a spider base plate 55, which is made up of two or more retractable plates that define a central circular opening 57, when in the inner position, through which riser joints 17 can pass.

A plurality of support braces 59 are mounted on spider 55 for radial sliding movement on spider base plate 55 relative to the axis of riser 11. Support braces 59 are spaced circumferentially around opening 57. Braces 59 are shown in an engaged position in FIG. 6 on the lower side of upper flange 20 for supporting the weight of the riser suspended below. Hydraulic cylinders 61 are shown in FIG. 7 for retracting each of the braces 59 to enable the riser to be lowered or raised. In the example shown, the cylinder portion of each hydraulic cylinder 61 is stationarily mounted to spider base plate 55 and its reciprocating rod is attached to an outer end of one of the braces 59. In the extended position, the inner end of each brace 59 is almost or may be in contact with central pipe 18. In the retracted position, the inner ends of braces 59 will be located radially outward of the perimeter of central opening 57.

Figure 6:
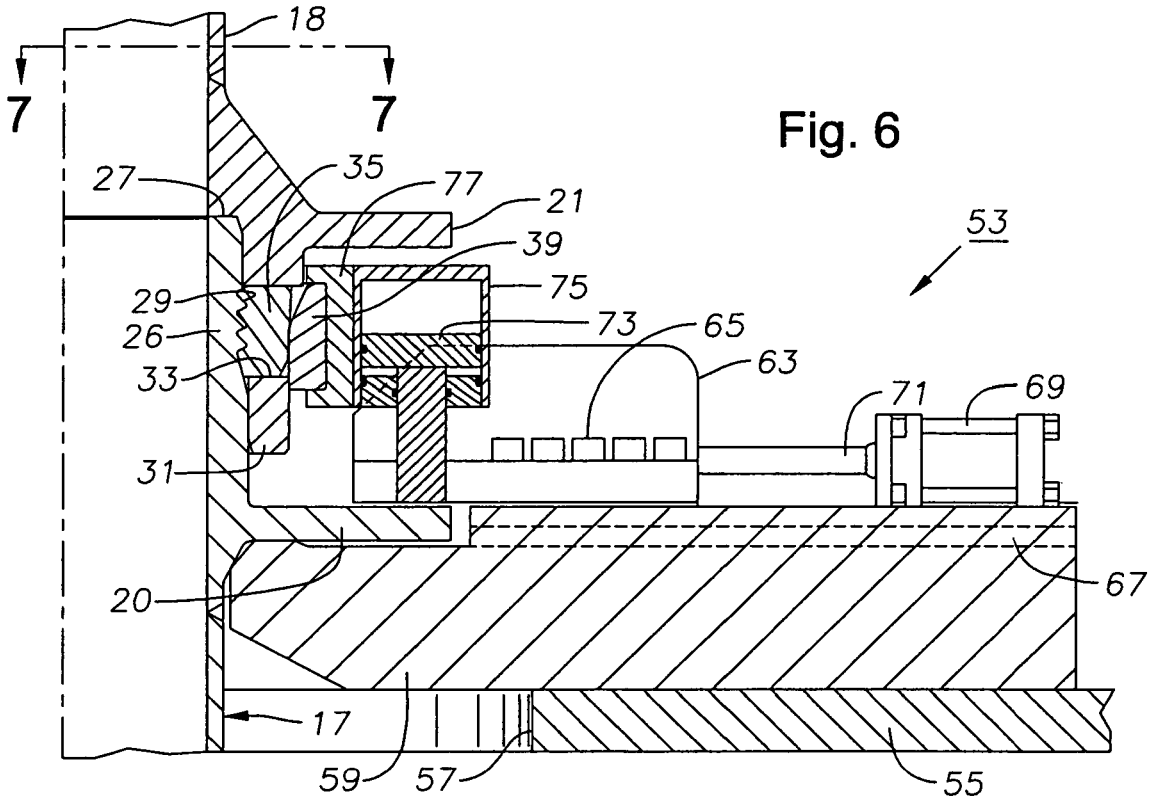
FIG. 6 is a sectional view of the riser coupling as shown in FIG. 5, and showing a handling tool for make up and break out of the riser coupling.
Figure 7:
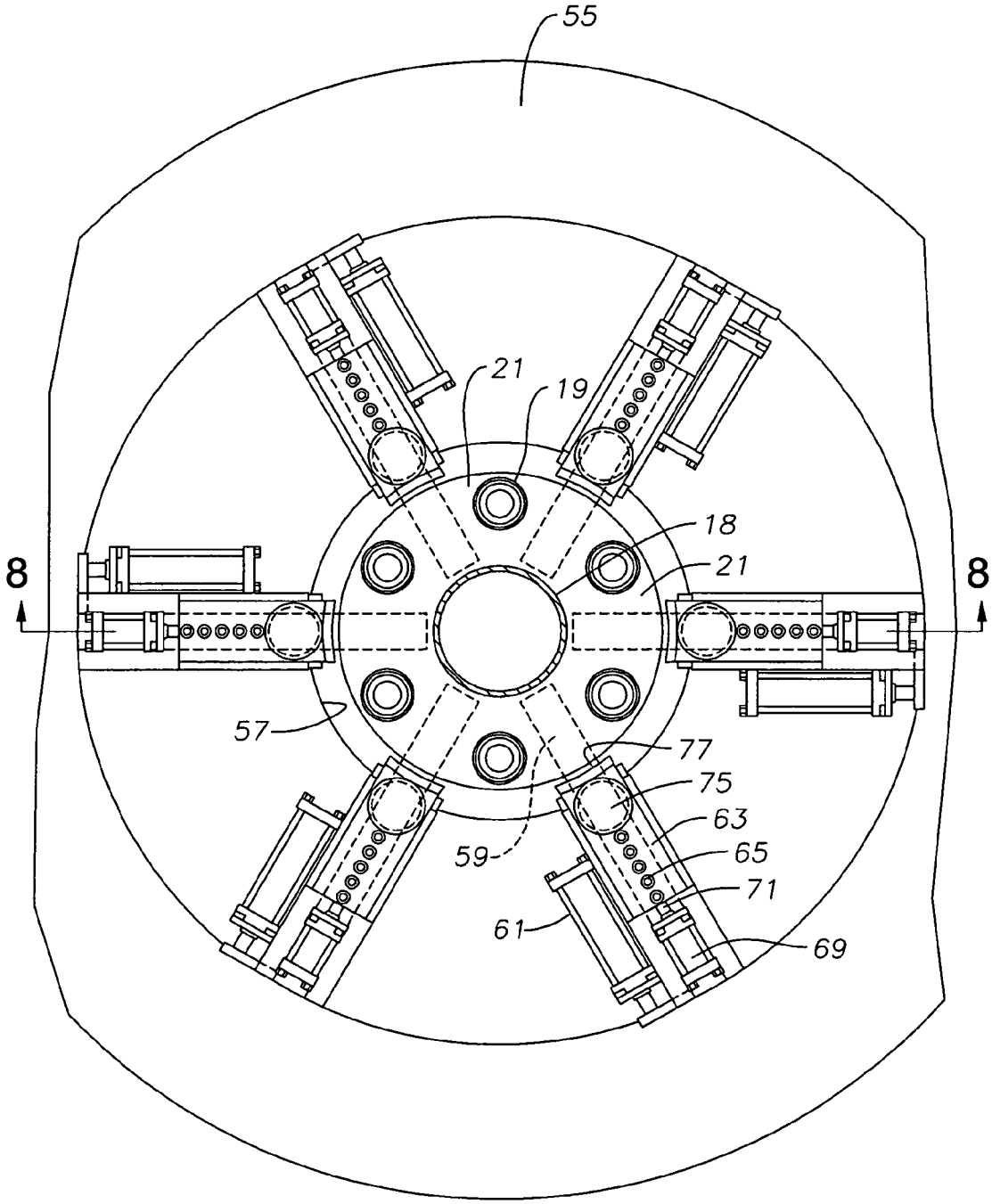
FIG. 7 is a sectional view of the riser coupling and handling tool shown in FIG. 6, taken along the line 7-7 of FIG. 6, but showing the handling tool in a retracted position.
Figure 8:
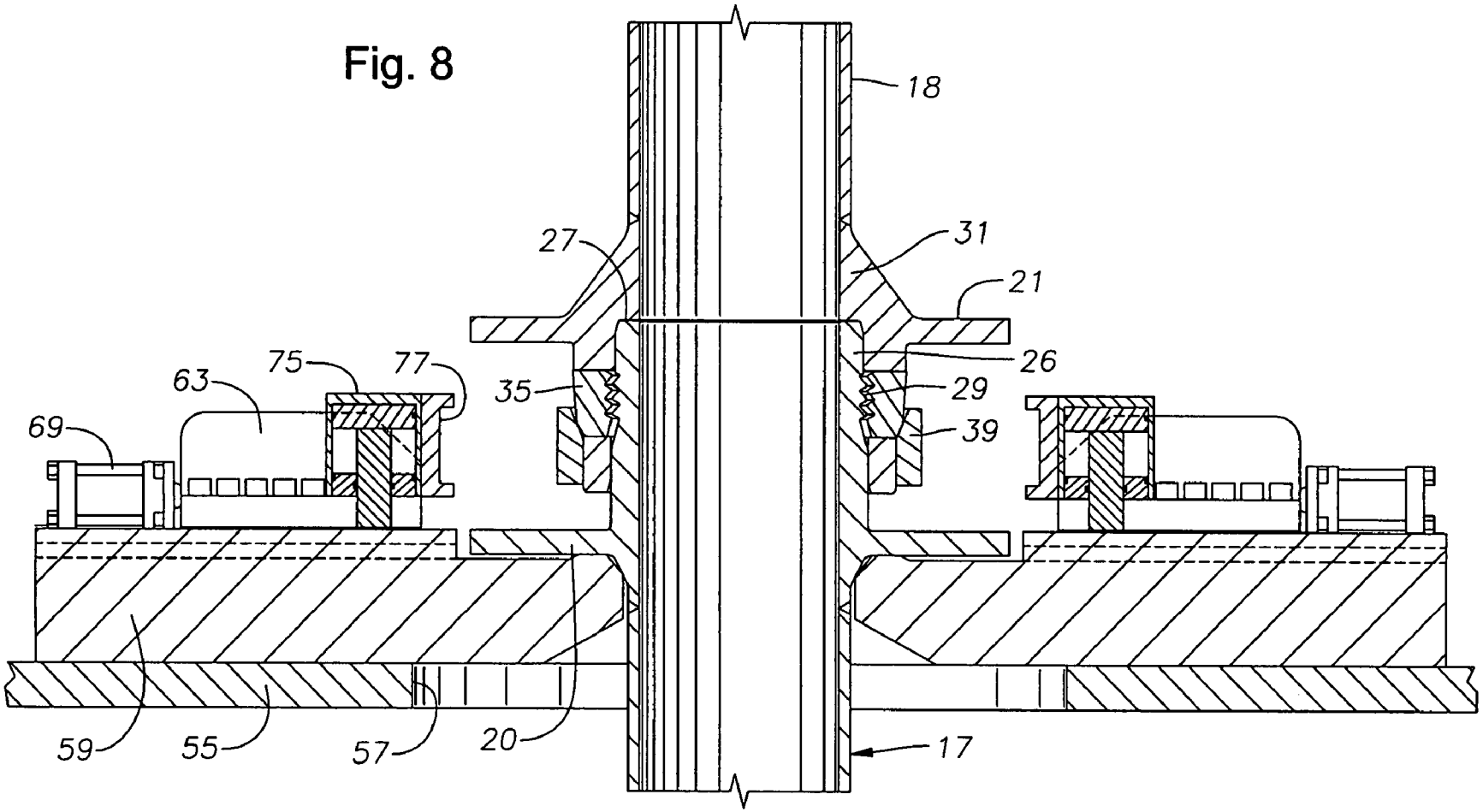
FIG. 8 is sectional view of the riser coupling and handling tool, taken along the line 8-8 of FIG. 7 and showing the handling tool in the retracted position.

A carriage 63 is slidably carried on each brace 59 between an inward engaged position, shown in FIG. 6, and an outward disengaged position, shown in FIG. 8. Carriage 63 has a plurality of retainer pins 65 with lugs on their lower ends, each of which slides within a T-shaped slot 67 in the upper side of each brace 59. A positioning hydraulic cylinder 69 strokes carriage 63 between the extended and retracted positions. In this example, each hydraulic cylinder 69 is stationarily mounted on one of the braces 59 and has a reciprocating rod 71 that engages each carriage 63.

Carriage 63 comprises a pair of spaced-apart vertical side plates that provide support for a vertically extending actuating piston 73. In this example, a movable cylinder 75 reciprocates relative to a fixed piston 73, but the reverse could be employed. Hydraulic fluid pressure will cause movable cylinder 75 to move between an upper and a lower position while piston 73 remains stationary. An engaging member or jaw 77 located on the inner side of each hydraulic cylinder 75 engages cam ring 39 to causes cam ring 39 to move upward and downward in unison with hydraulic cylinders 75. Jaw 77 is a channel member with upper and lower horizontal flanges that slide over the upper and lower sides of cam ring 39. The lower flange of jaw 77 will depress and release detent 43 (FIG. 3) from cam ring 39 when cam ring 39 is in the upper position to enable cam ring 39 to be pulled downward during break out of riser joints 17.

In operation, when making up riser 11 (FIG. 1) for lowering into the sea, the operator places spider base plate 55 in an inner position, defining central opening 57 for riser 11. The operator retracts braces 59 (FIG. 7) and jaws 77 (FIG. 8), and makes sure that cam ring 39 is in the lower position shown in FIG. 8. The operator then lowers a first riser joint 17 through opening 57 (FIG. 8) and connects it to lower marine riser package 23 (FIG. 1), which is normally stored below platform 13. The operator causes hydraulic cylinders 61 (FIG. 7) to move braces 59 inward, then lowers the first riser joint 17 until upper flange 20 is resting on braces 59, as shown in FIG. 8. The operator lowers a second riser joint 17 and lands it on the upper end of the first riser joint 17, as shown in FIG. 8.

Figure 9:
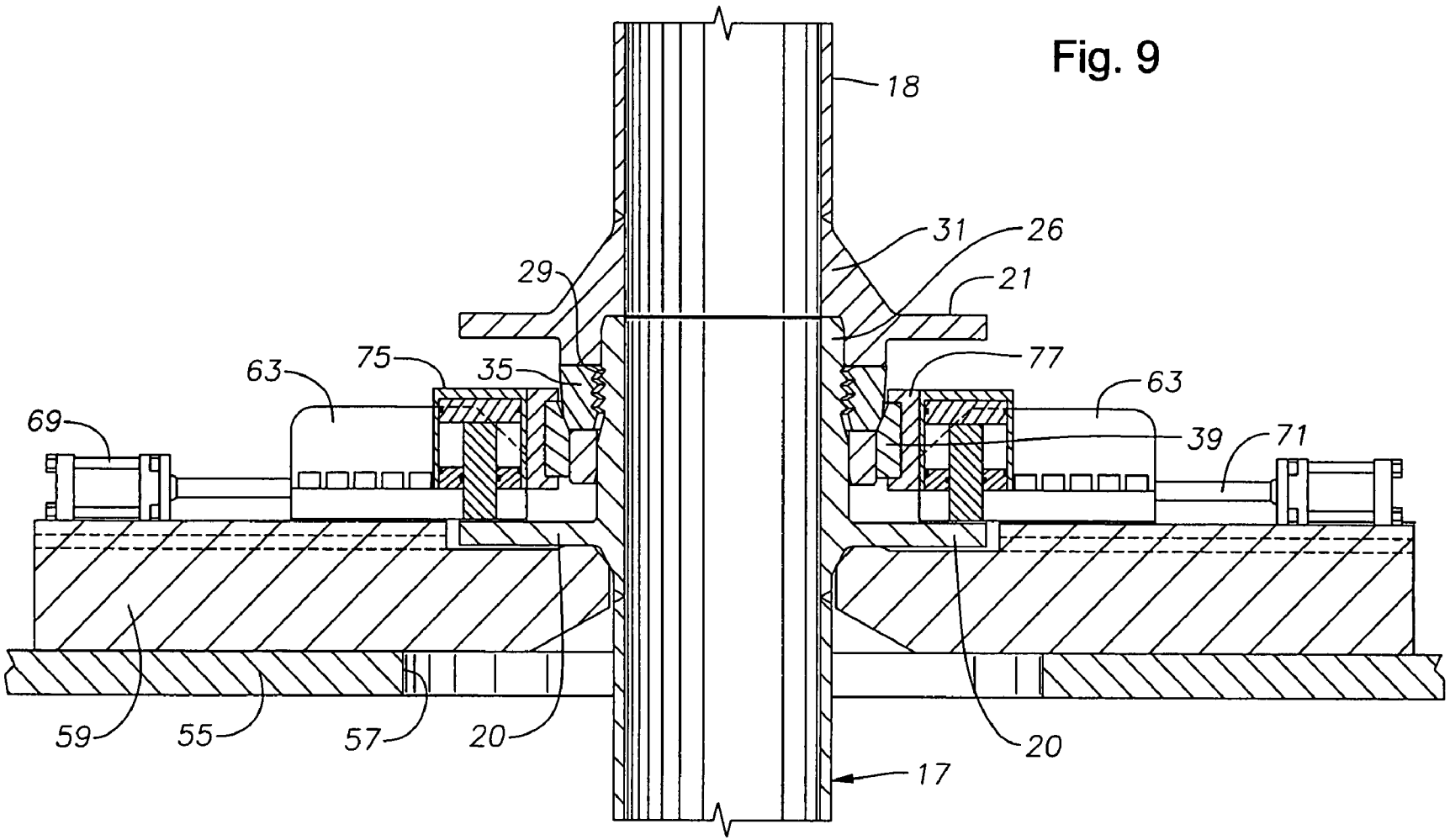
FIG. 9 is a sectional view of the riser coupling and handling tool of FIG. 8, but showing the handling tool in an engaged position.
Figure 10:
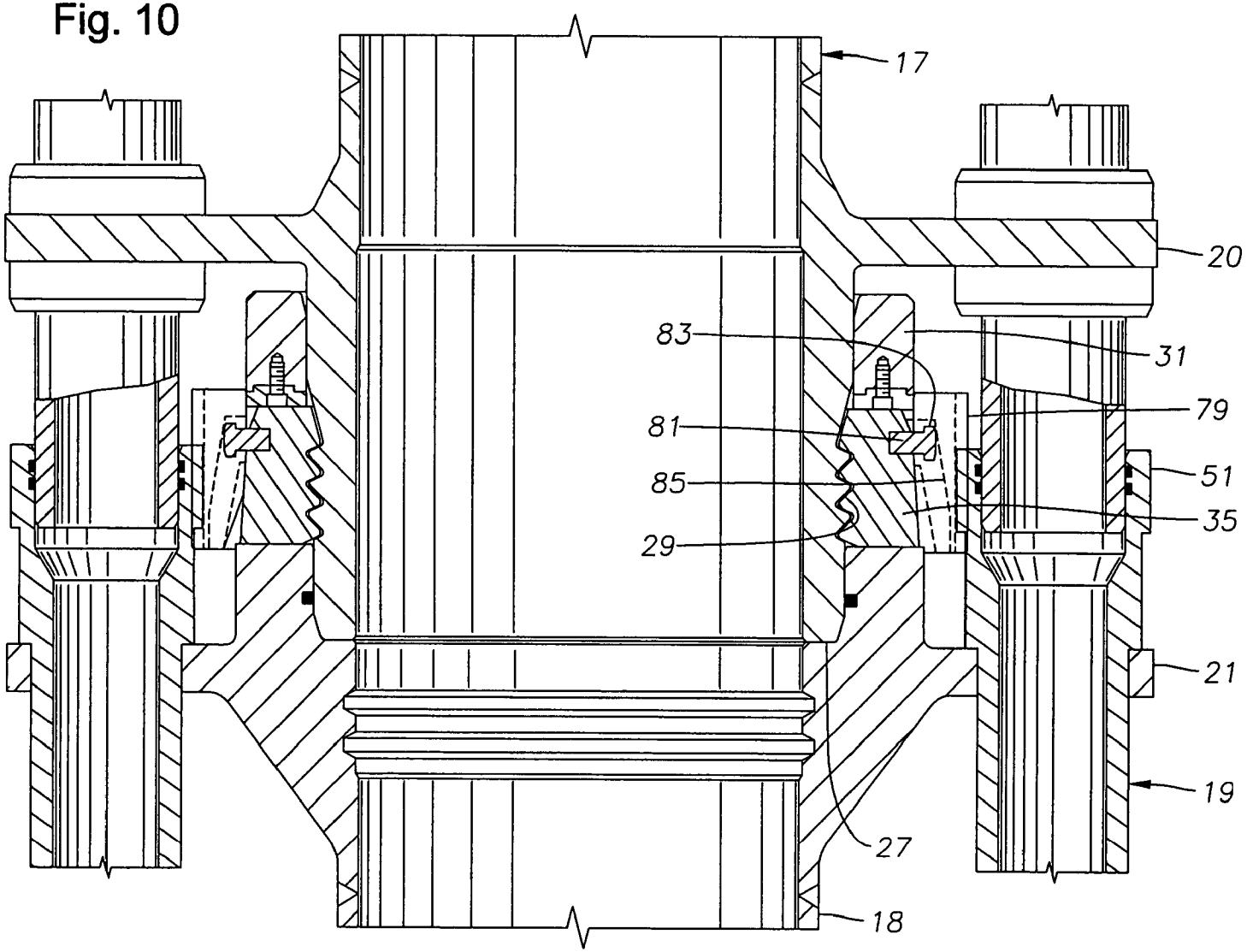
FIG. 10 is a sectional view of an alternate embodiment of a riser coupling, shown in a locked position.

The operator then applies pressure to hydraulic cylinders 69 to cause jaws 77 to engage cam ring 39, as shown in FIG. 9. The operator then supplies hydraulic pressure to actuating cylinders 75 to move cam ring 39 to the upper position shown in FIG. 6. When moving to the upper position, cam ring 39 will push locking segments 35 into locking engagement with profile 29. While doing so, the connection between the riser joints 17 will become preloaded. The operator then retracts hydraulic cylinders 69 to retract jaws 77 and moves actuating cylinders 75 back to a lower position. Once jaws 77 are released from cam ring 39, detents 43 (FIG. 3) will snap under cam ring 39 to make sure that it does not move downward.

When the operator is ready to install the next riser joint 17, he lifts the entire riser string from support braces 59, retracts braces 59 with hydraulic cylinders 61 (FIG. 7), and lowers riser 11 for the length of one riser joint 17 to repeat the cycle. The operator can break out the joints 17 of riser 11 by reversing the procedure.

FIGS. 10-17 illustrate a second embodiment. Riser joints 17 are constructed generally the same as in the first embodiment, except the coupling is inverted. The same numerals are employed for components that are substantially the same. During make up, box 31 is on the upper end of a riser joint 17 and faces upward. Pin 26 is on the lower end of the next riser joint 17 for stabbing into box 31. A cam ring 79 is moved from an upper position downward to push locking segments 35 into locking engagement with the profile on pin 26.

As in the first embodiment, cam ring 79 has a tapered interior that matches the exterior of each locking segment 35. In this embodiment, a lug 81, which may be a bolt, is secured to each locking segment 35 and extends outward. Lug 81 has an enlarged head 83 on its end. Cam ring 79 has an internal slot 85 for each lug 81. Slot 85 has an enlarged width portion 85*a* (FIG. 11) that will receive head 83. A reduced width portion 85*b* is located radially inward from enlarged width portion 85*a* to trap head 83 within slot enlarged portion 85*a*, but allow sliding vertical movement of cam ring 79. As cam ring 79 moves downward, it will slide relative to lug 81. Slot reduced width portion 85*b* is tapered so that when cam ring 79 is pushed upward, it will exert an outward force on lug head 83, pulling locking segment 35 radially outward from engagement with pin profile 29.

Figure 12:
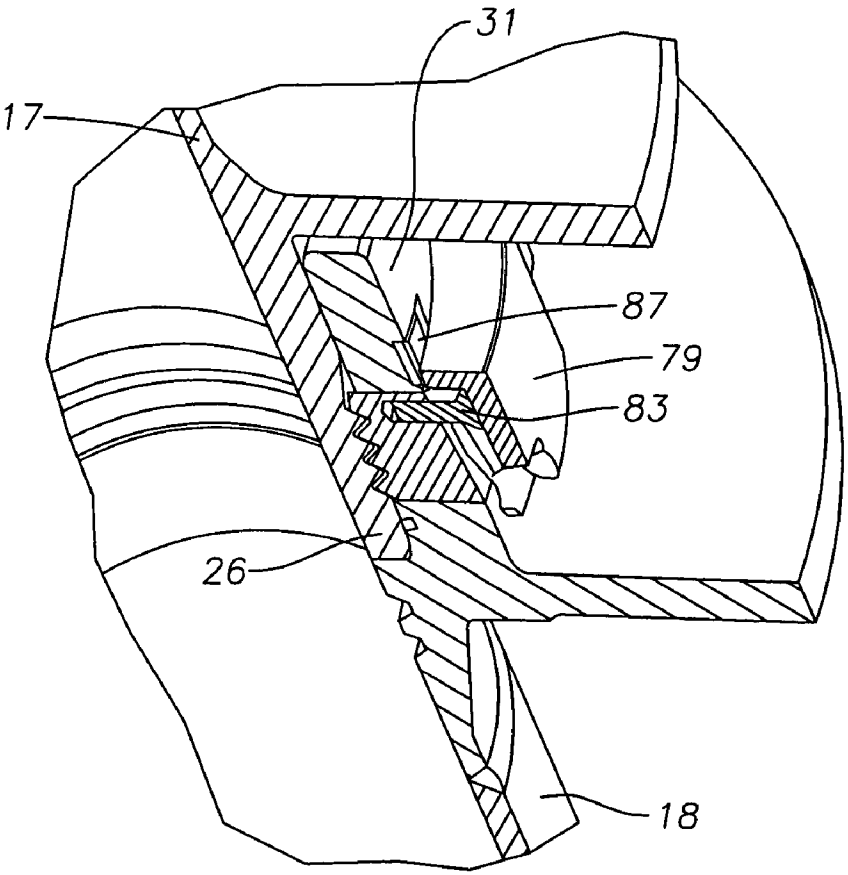
FIG. 12 is a perspective view of the detent shown in FIG. 11, along with a portion of the riser.
Figure 11:
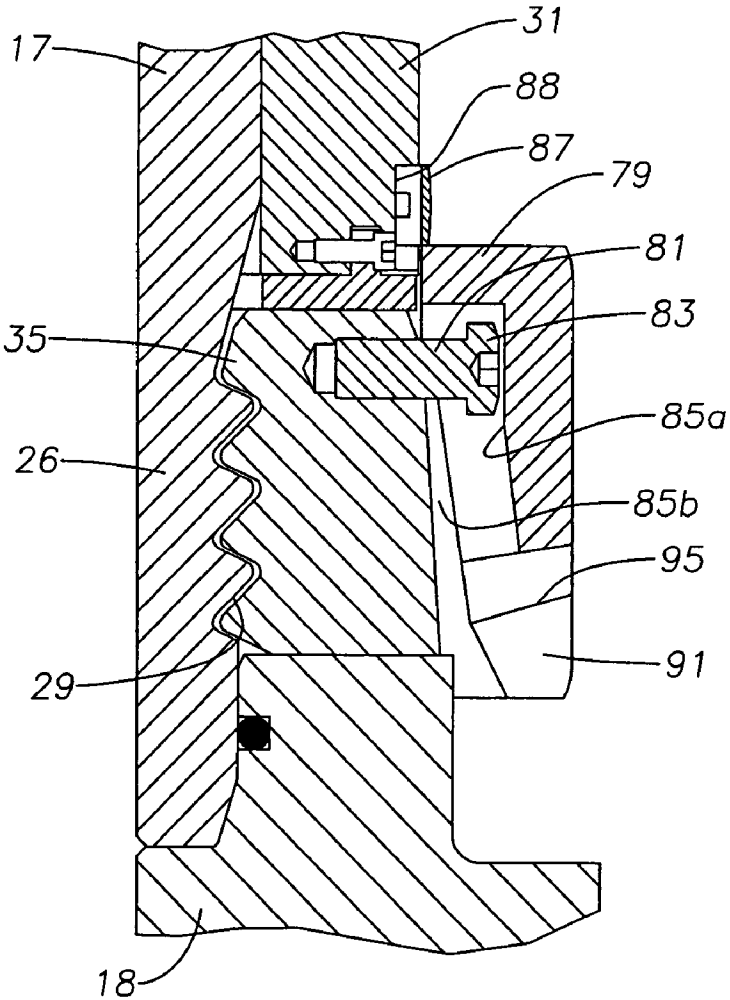
FIG. 11 is an enlarged view of a portion of the coupling of FIG. 10, and illustrating a detent for holding the cam ring in an upper position.

FIG. 11 illustrates a detent 87 that may be employed to releasably retain cam ring 79 in an upper position. Detent 87 comprises a flat tab of resilient metal, forming a spring, as illustrated in FIG. 12. A plurality of detents 87 are spaced around box 31, each located a short distance above locking segments 35. A recess 88 formed in the exterior of box 31 for each detent enables each detent 87 to deflect inward. Preferably, each detent 87 protrudes outward from the exterior of box 31 a short distance, serving also to resist upward movement of cam ring 79 while detents 87 are in their natural positions shown in FIG. 11. The makeup tool, to be described subsequently, pushes detents 87 inward into recesses 88 when it engages the coupling, thereby allowing cam ring 79 to be moved upward. When cam ring 79 is in the upper position, a lower portion of its interior will rest on the protruding detents 87 to hold cam ring 79 in the upper position. Other types of detents are feasible.

Figure 13:
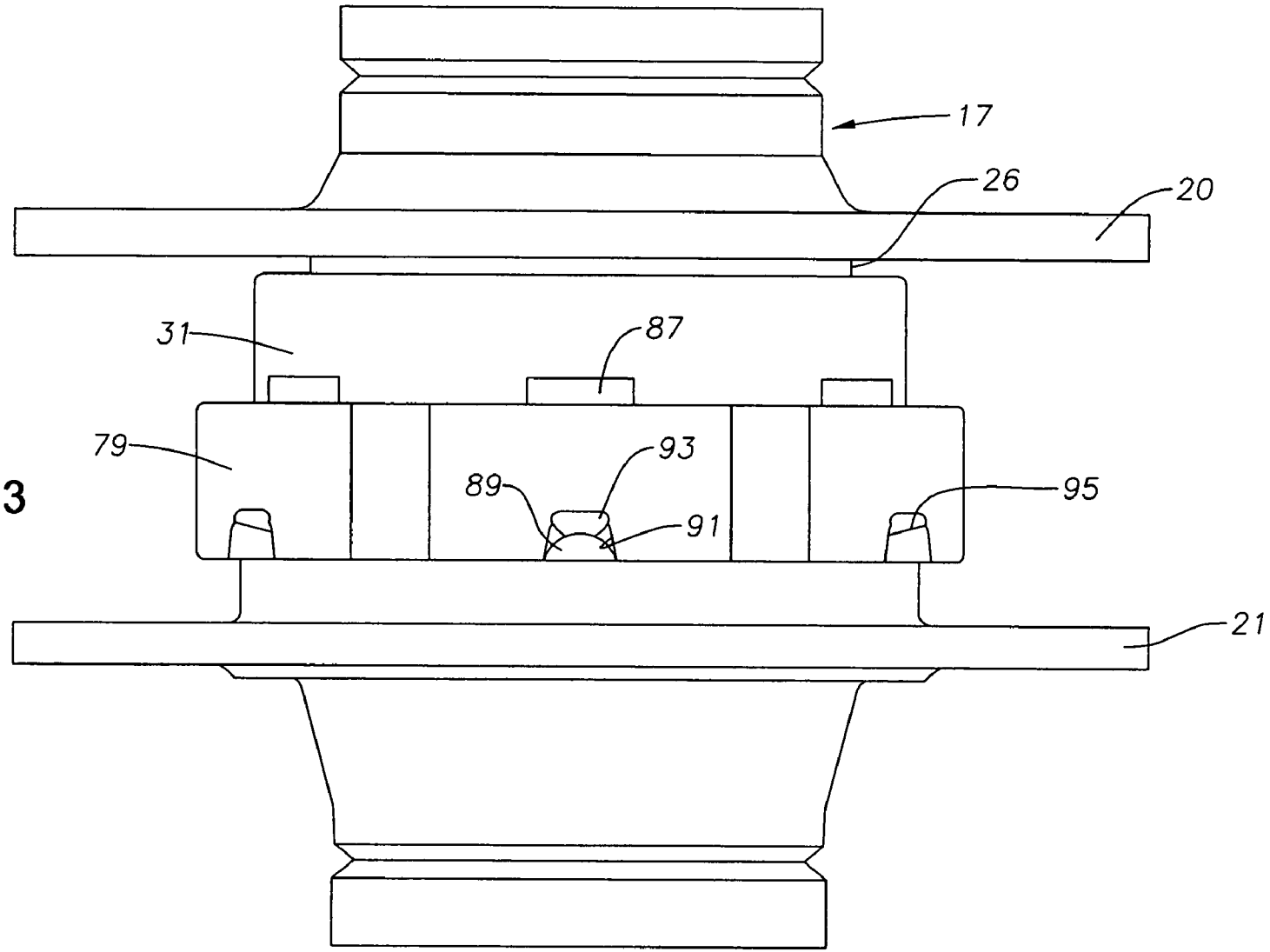
FIG. 13 is a side elevational view of the riser coupling of FIG. 10, showing a latch for latching the cam ring in the locked position.

FIG. 13 illustrates a plurality of optional latches 89 that latch cam ring 79 in a lower, locked position. Latches 89 are spaced circumferentially around the exterior of box 31. In this embodiment, each latch 89 is located directly below one of the detents 87. A notch 91 is formed in the lower edge of cam ring 79 for sliding over each latch 89. Latch 89 may have a variety of configurations for snapping into engagement with a portion of notch 91. In this example, latch 89 has a pair of spring-biased lobes 93 that engage shoulders 95 formed on opposite sides of each notch 91. An upward force on cam ring 79 of sufficient magnitude will cause latches 89 to release.

Figure 14:
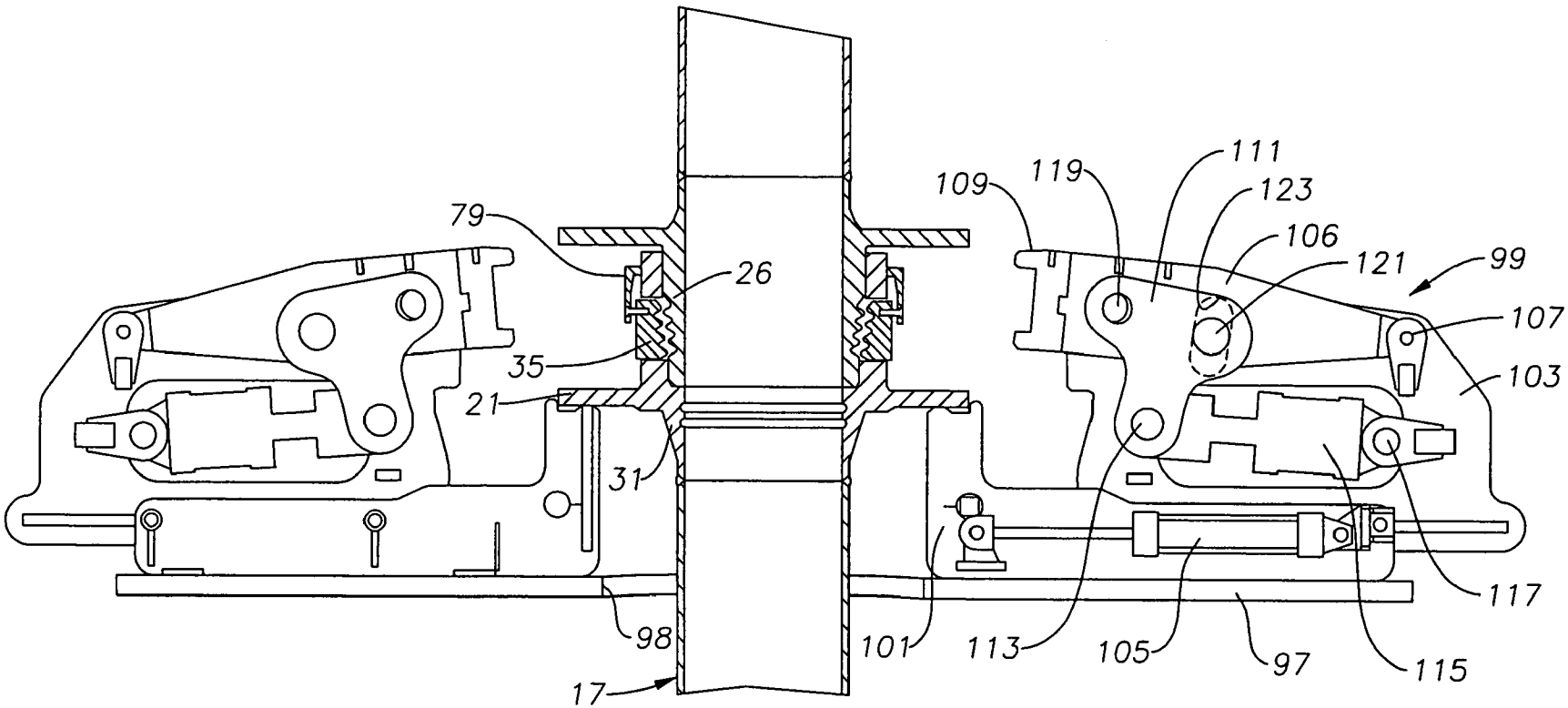
FIG. 14 is a sectional view of the coupling of FIG. 10, and illustrating a makeup tool for making up and breaking out the coupling, and shown in a retracted position.

Referring to FIG. 14, an example of handling equipment for making up and breaking out the coupling of FIGS. 3-5 or FIGS. 10-13 is illustrated. The handling equipment includes a plurality of spider base plates 97. Base plates 97 comprise two or more segments that surround riser 11 and are moved from a retracted position (not shown) to an inner position, which is shown in FIG. 14. In the inner position, the inner partially circular edges of spider base plates 97 define a circular opening 98 through which the riser extends. Opening 98 is smaller in diameter than riser flanges 21. Spider base plate segments 97 are moved between the retracted and inner positions by hydraulic cylinders (not shown).

A plurality of makeup units 99 are mounted on spider base plates 97 around opening 98. Units 99 (only two shown), are oriented on radial lines extending from the axis of opening 98. Preferably, each makeup unit 99 comprises a pair of parallel upright support braces 101. An inner portion of each support brace 101 engages the lower side of one of the riser flanges 21 for supporting the string of riser. Support braces 101 may be rigidly mounted to spider base plates 97 and move in unison with them between the retracted and inner positions.

Each makeup unit 99 also has a carriage 103 that is mounted between the two support braces 101 of each unit. Carriage 103 comprises a pair of upright parallel plates (only one shown). Each carriage 103 moves from a retracted position (FIG. 14) to an engaged position (FIG. 15), relative to spider base plate 97 and support braces 101. Preferably this movement is handled by a horizontally oriented positioning hydraulic cylinder 105. Each carriage 103 supports an arm 106 that extends between the two parallel upright plates of carriage 103 along a radial line of the axis of opening 98. Arm 106 has an outer end connected by a pivot pin 107 to carriage 103. An engaging member 109 is mounted to an inner end of arm 106. Engaging member 109 may be similar to jaw 77 of FIG. 6 or it may differ. In this embodiment, engaging member 109 comprises upper and lower flanges that protrude inward for fitting on the upper and lower sides of cam ring 79, similar to jaw 77.

A pair of links 111 (only one shown), are mounted on opposite sides of arm 106 of each unit 99 for causing engaging member 109 to move between upper and lower positions. Each link 111 in this example is a generally triangular plate, having a pivot pin 113 on its lower end that pivotally mounts to one end of an actuating hydraulic cylinder 115. The opposite end of actuating hydraulic cylinder 115 is connected by a pivot pin 117 to the two upright support plates of carriage 103. Link 111 has a forward hole that loosely fits around a pivot pin 119 extending from arm 106. Link 111 has an outer pivot pin 121 that extends into an elongated hole 123 formed in each vertical plate of carriage 103.

Figure 15:
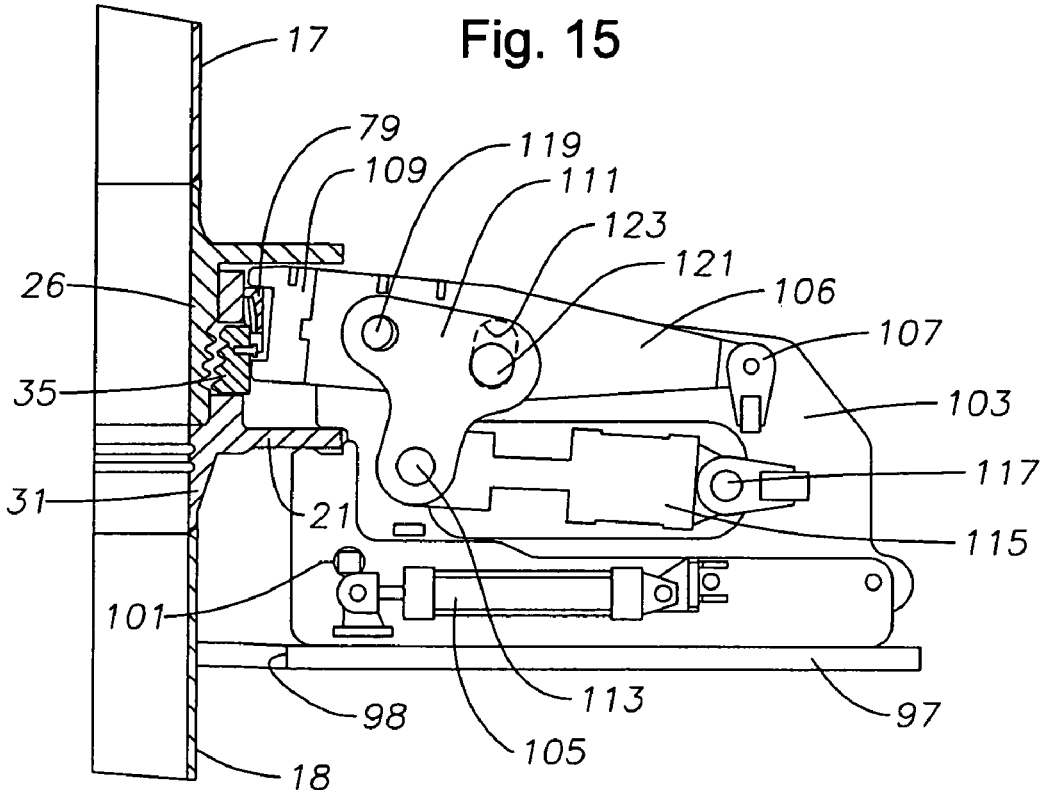
FIG. 15 is a partial sectional view of the makeup tool of FIG. 14, and showing the tool in an engaged position, prior to moving the cam ring down to the locked position.
Figure 16:
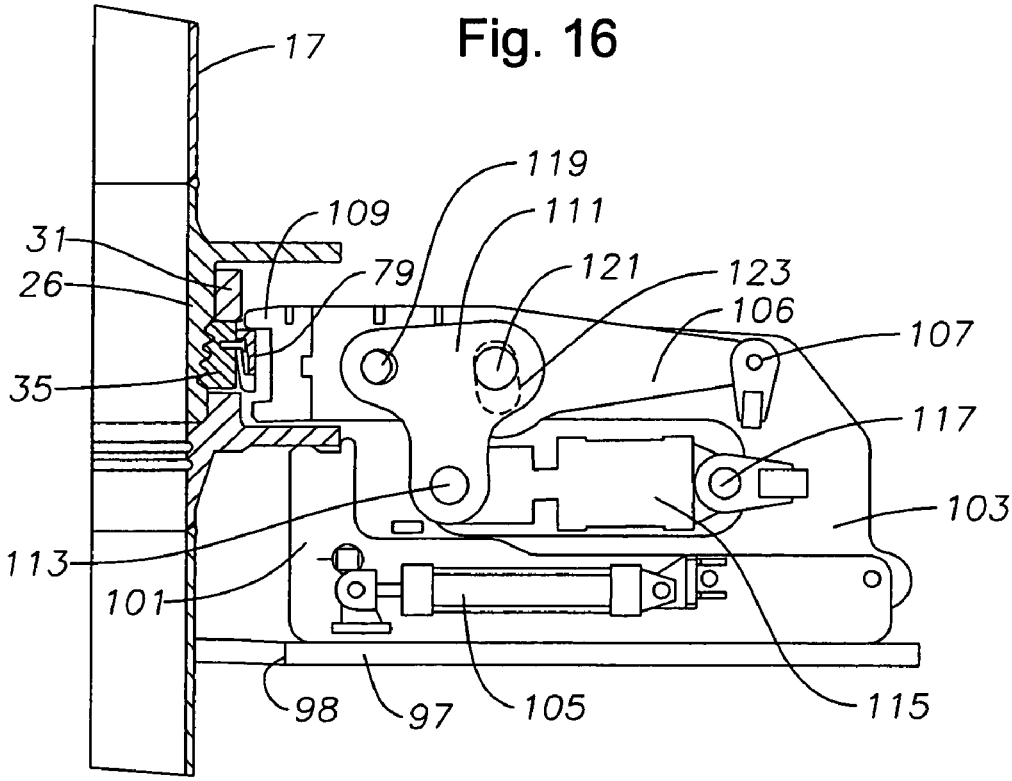
FIG. 16 is a sectional view similar to FIG. 15, but showing the cam ring and the makeup tool in the locked position.

In the operation of the embodiment shown in FIGS. 14-16, spider base plates 97 are moved to the inner position to define opening 98, and riser joint 17 is lowered until its flange 21 is supported on support braces 101. The operator lowers a next riser joint 17 and stabs its pin 26 into box 31 of the riser joint 17 being supported by support braces 101. The operator then strokes positioning hydraulic cylinders 105, causing carriages 103 to move inward from the position shown in FIG. 14 to that shown in FIG. 15. In the inner position, engaging member 109 will engage cam ring 79.

The operator then supplies power to actuating cylinders 115, which move from a retracted position shown in FIGS. 14 and 15 to the extended position of FIG. 16. This movement causes engaging members 109 to fully engage cam ring 79 and to depress detent springs 87 (FIG. 11). Continued movement of actuating cylinders 115 causes engaging members 109 to move downward. When cam ring 79 reaches the lower position, latches 89 (FIG. 13) snap into engagement with shoulders 95 in notches 91 to releasably secure cam ring 79 in the lower position. Also, detent springs 87 spring outward as cam ring 79 passes below them, illustrated in FIG. 11.

Once in the locked position of FIG. 16, the operator supplies power to positioning hydraulic cylinders 105, causing each unit 99 to move to the retracted position of FIG. 14. The operator retracts actuating cylinders 115, which move arm engaging members 109 back to an upper position for the next coupling. The operator picks up the connected riser joints 17 with the derrick and drawworks (not shown), then retracts spider base plates 97 and support braces 101. The operator then lowers the riser joints 17 downward until the next coupling is reached.

Figure 17:
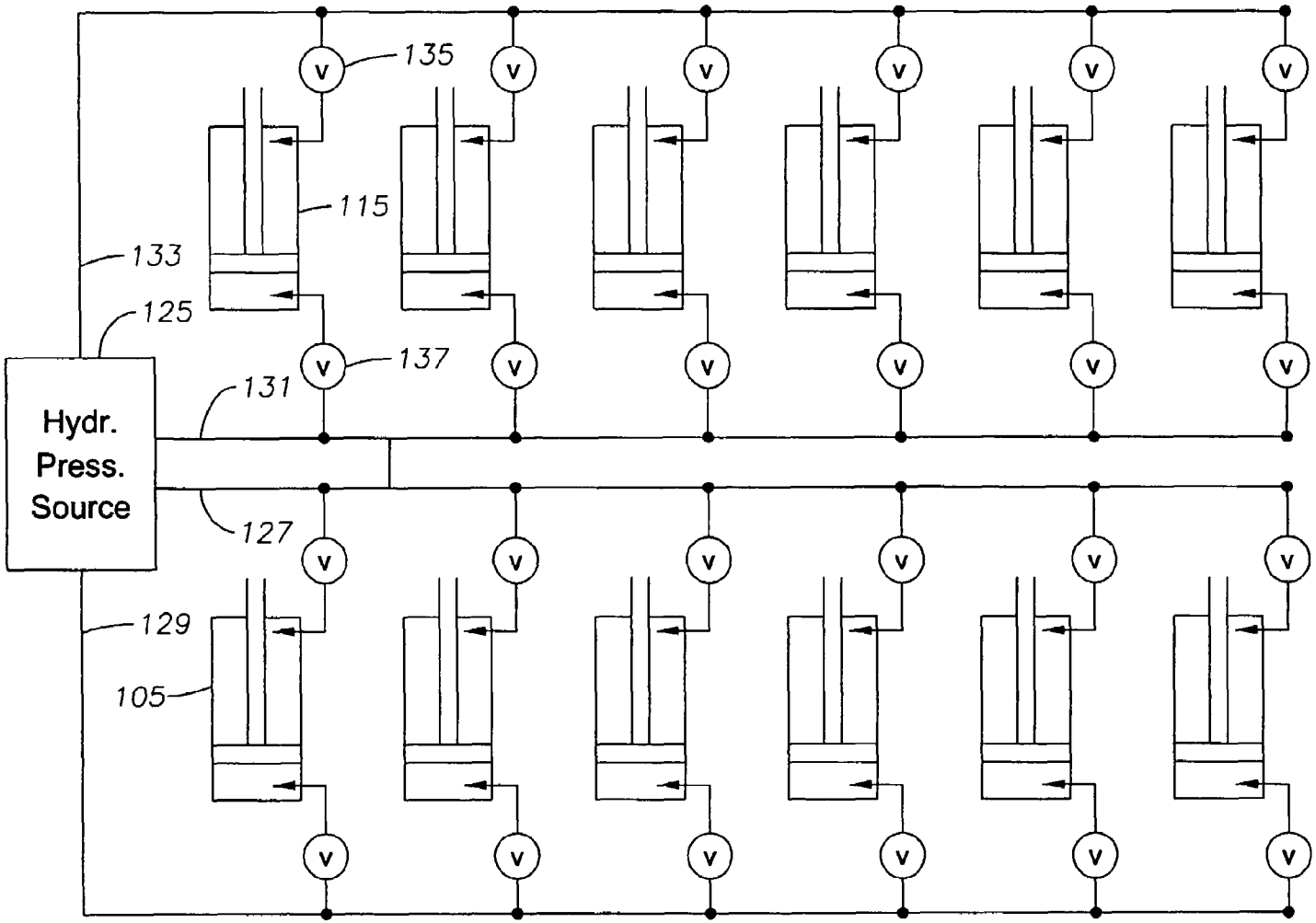
FIG. 17 is a schematic view illustrating the hydraulic circuitry of the makeup tool of FIG. 14.

Preferably, the hydraulic capacities for both the embodiments of FIGS. 6-9 and 14-16 are more than what is required to perform the function. This allows the equipment to continue operating if one or more of the units fail. For example, FIG. 17 illustrates the hydraulic circuit for the second embodiment of FIGS. 14-16. In this example, there are six units 99 (FIG. 14), each having a hydraulic positioning cylinder 105 and an actuating cylinder 115. A hydraulic pressure source 125 supplies hydraulic fluid pressure to positioning cylinders 105 in parallel via hydraulic lines 127, 129. Similarly, hydraulic pressure source 125 supplies hydraulic pressure to actuating cylinders 115 in parallel via hydraulic lines 131 and 133. Each hydraulic cylinder 115 is connected to main lines 131 and 133 via branch lines containing valves 135, 137. Valves 135, 137 are also utilized for connecting each positioning hydraulic cylinder 105 to main lines 127, 129.

In this manner, as long as the remaining hydraulic cylinders 105, 115 have sufficient capacity to support the riser string weight and to move cam ring 39 (FIG. 3) or cam ring 79 (FIG. 10), one or more of the hydraulic cylinders 105, 115 can be deleted from operations simply by actuating valves 135, 137 to a closed position. For example, in a preferred embodiment, three of the units 99 (FIG. 14) are adequate for the makeup and breakout of a riser coupling. Consequently, three hydraulic cylinders 105, 115 could be deactivated by closing valves 135, 137. Preferably, the three to be deactivated would not be all located next to each other so as to avoid an imbalance of force being applied. The system shown in FIG. 17 allows operation to continue in the event of leakage or failure of one or more of the cylinders 105, 115.

Figure 18:
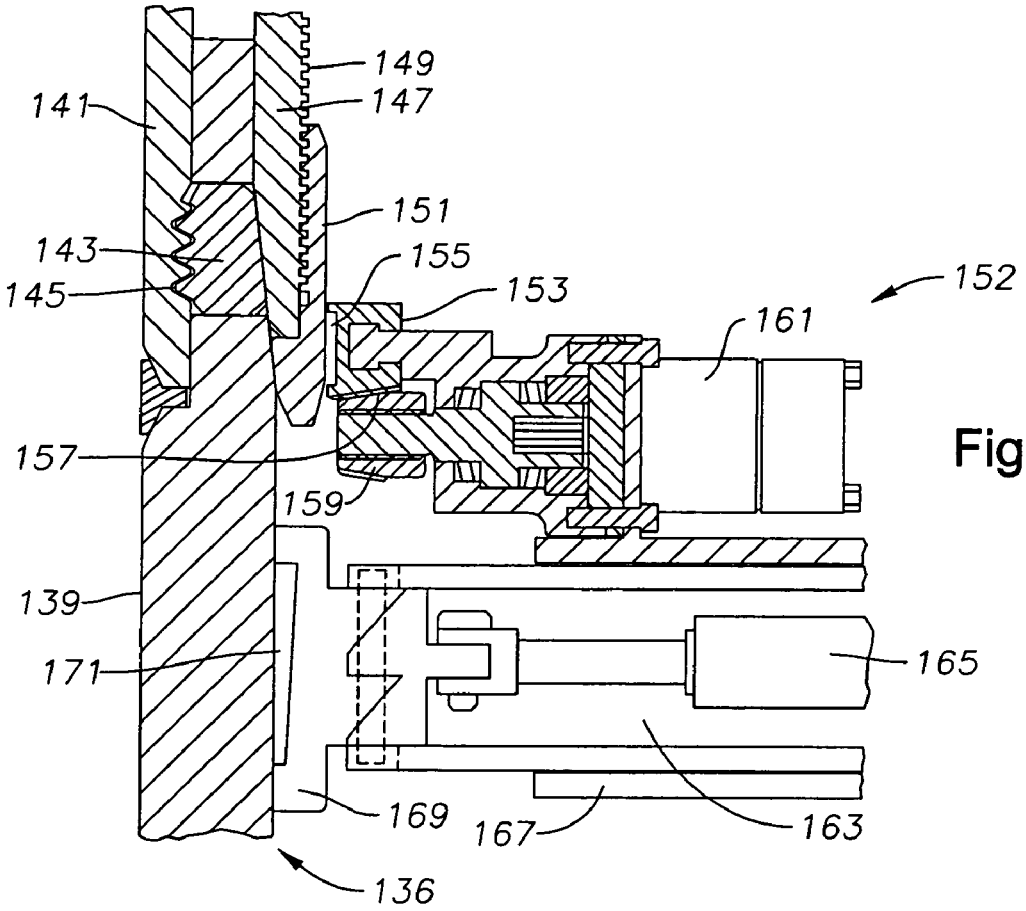
FIG. 18 is a side sectional view of a portion of an alternate embodiment of a riser coupling and of a makeup tool.
Figure 19:
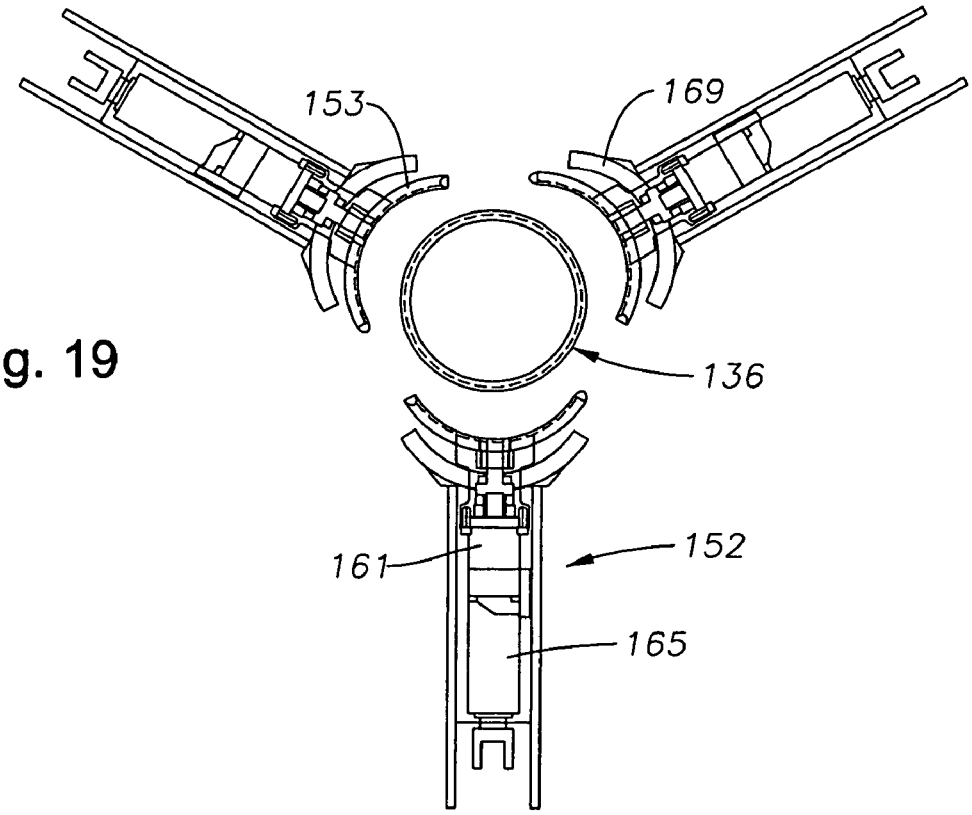
FIG. 19 is a top, partially sectioned view of the makeup tool of FIG. 18.

Referring to FIGS. 18 and 19, in this embodiment a riser is illustrated without auxiliary lines. The riser may be a high pressure drilling riser of the type for use with a surface blowout preventer. Each riser joint 136 has a riser box 139 that receives a riser pin 141 of the next riser joint stabbed in from above. A plurality of locking segments 143 are carried in windows within riser box 139. Each locking segment 143 has a profile 145 on its inner end for engaging a mating profile on riser pin 141.

A cam ring 147 is carried on the exterior of riser box 139 for axial movement. Cam ring 147 is held against rotation by splines or pins (not shown). Cam ring 147 slides between the upper position shown in FIG. 18 to a lower position. When doing so, the inner tapered side of cam ring 147 pushes against the outer tapered sides of locking segments 143 to move them to the locked position. In this embodiment, cam ring 147 has threads 149 on its exterior. An actuator ring 151 locates on the outer side of cam ring 147 and has threads on its interior that mate with threads 149. Rotating actuator ring 151 will cause cam ring 147 to move axially between upper and lower positions.

Various makeup tools may be employed to cause actuator ring 151 to rotate. In this embodiment, three makeup units 152 are shown (FIG. 19), but the number could be fewer or more. Each makeup unit 152 has a rack segment 153, which is an arcuate member of a diameter approximately that of the outer diameter of actuator ring 151. With three units 152, each rack segments 153 extends up to 120 degrees. Each rack segment 153 has an engaging member 155 on its inner end for engaging actuator ring 151. In this embodiment, a friction pad serves as the engaging member 155 for frictionally engaging the outer diameter of actuator ring 151. Alternately, engaging member 155 could be of another type, such as a pin member that engages a hole or recess formed in actuator ring 151.

Each rack segment 153 has a plurality of gear teeth 157 formed along its lower edge. A spur gear 159 is mounted below each rack segment 153 in engagement with teeth 157. Spur gear 159 is rotated by a rotating source, such as a hydraulic motor 161. Hydraulic motor 161 is mounted to a support beam 163. A positioning hydraulic cylinder 165 will stroke hydraulic motor 161 and rack segment 153 between retracted and engaged positions relative to support beam 167. Support beam 163 is mounted on a spider base plate 167, which is not shown in FIG. 19. Spider base plate 167 moves radially between retracted and inner positions, and define an opening for the riser when in the inner position.

Each unit 152 has an arcuate support 169, each support 169 having a set of slips 171. Slips 171 comprise wedge-shaped segments carried in recesses and having teeth for gripping the exterior of riser box 139. Supports 169 are mounted to the inner ends of support beams 163 for engaging riser box 139 to support the weight of the riser. Other devices for supporting the riser string are feasible.

In the operation of the embodiments of FIGS. 18 and 19, riser joint 136 will be lowered through an opening in the riser deploying floor, and spider base plates 167 will be moved inward, as shown in FIG. 18, which causes slips 171 to engage and support the weight of the riser while the next riser joint is lowered in place. During this interval, units 152 are in the retracted position shown in FIG. 19. After pin 141 of the new riser joint stabs into box 139 of the riser joint 136 held by slips 171, the operator supplies power to positioning hydraulic cylinders 165 to move engaging member 155 into engagement with the outer diameter of cam ring 151. The operator then supplies power to hydraulic motors 161, which in turn causes spur gears 159 to rotate rack segments 153 a selected number of degrees. This rotation causes actuator ring 151 to turn relative to cam ring 147. Threads 149 cause cam ring 147 to move down, pushing each riser locking segment 143 into engagement with the profile on pin 141.

The invention has significant advantages. The embodiments shown do not employ bolts, which can be lost or damaged. Moreover, the system does not require the presence of personnel in the vicinity of the riser coupling on the riser deploying floor while it is being made up or broken out. The system is automated and fast.

While the invention has been shown in only a few of its forms, it should be apparent to those skilled in the art that it is not so limited but it is susceptible to various changes without departing from the scope of the invention. For example, although the handling tool in the embodiment of FIGS. 18 and 19 is shown in connection with a riser that does not employ auxiliary lines around its circumference, it could be utilized with a riser having auxiliary lines.

The invention claimed is:

1. An offshore riser system, comprising:

a riser deploying floor having an opening;

first and second riser joints, each having a longitudinal axis, a box on one of the riser joints and a pin on the other of the riser joints;

the pin having an external grooved profile formed thereon;

at least one locking element carried by the box for movement from an unlocked position into a locked position in engagement with the profile of the pin;

a ring in engagement with the locking element;

a retractable spider supported by the floor at the opening for supporting the first riser joint in the opening while the end of the second riser joint is stabbed into engagement with the end of the first riser joint; and a make-up tool supported by the floor at the opening for moving the ring relative to the locking element, causing the locking element to move to the locked position to connect the first and second riser joints together.

2. The system according to claim 1, wherein the make-up tool moves the ring axially when moving the ring to the locked position.

3. The system according to claim 1, wherein the make-up tool rotates the ring to cause the locking element to move to the locked position.

4. The system according to claim 1, wherein the make-up tool comprises:

an engaging member;

a positioning device for moving the engaging member inward from a retracted position to an engaged position in engagement with the ring; and an actuating device for moving the engaging member axially to move the ring axially from the unlocked to the locked position.

5. The system according to claim 1, wherein the make-up tool comprises a plurality of units mounted around the opening in the riser deploying floor, each of the units comprising:

an engaging member;

a positioning device for moving the engaging member inward from a retracted position to an engaged position in engagement with the ring; and an actuating device for moving the engaging member axially to move the ring axially from the unlocked to the locked position.

6. The system according to claim 1, further comprising:

a retainer mounted to the box for retaining the ring in the locked position; and wherein the make-up tool engages and releases the retainer when moving the ring from the locked to the unlocked position to disconnect the first and second riser joints.

7. The riser system according to claim 1, further comprising a detent that exerts a force on the ring to releasably hold the ring in the unlocked position; and wherein the make-up tool has sufficient force to overcome the force exerted by the detent when moving the ring to the locked position.

8. The riser system according to claim 1, wherein:

the locking element has an outward-facing cam surface; and the ring has an inward-facing cam surface that slides against the cam surface of the locking element as the ring moves to force the locking element to the locked position.

9. The riser system according to claim 1, wherein said at least one locking member comprises:

a plurality of segments spaced around the box.

10. A riser system for connection between a riser deploying floor and a subsea facility, comprising:

a plurality of riser joints, each of the riser joints having a pipe with a longitudinal axis, a box on one end and a pin on an opposite end, the box having an interior that receives the pin of an adjacent one of the riser joints;

the pin of each riser joint having an external grooved profile formed thereon;

a plurality of segments carried by the box of each of the riser joints for movement from an unlocked position into a locked position in engagement with the profile of an adjacent one of the riser joints;

a ring encircling the box of each of the riser joints and having a cam surface in engagement with an outer side of each of the segments for causing the segments to move to the locked position in response to axial movement of the ring in a first direction relative to the locking element; and a make-up tool, comprising:

at least one make-up unit for mounting to the riser deploying floor, comprising:

an engaging member movably mounted to the unit for engagement with the ring;

a positioning device that moves the engaging member radially inward toward the axis of the riser from a retracted position to an engaged position; and an actuating device for moving the engaging member axially to move the ring axially from the unlocked to the locked position.

11. The system according to claim 10, wherein said at the least one unit comprises:

a plurality of the units for positioning on the riser deploying floor around the axis of the riser joints.

12. The system according to claim 10, wherein each of the riser joints further comprises:

a pair of flanges, each extending radially from the pipe adjacent each of the ends; and a plurality of auxiliary tubes spaced around each of the pipe and supported by the flanges at the opposite ends of the pipe.

13. The system according to claim 10, wherein the ring of each of the riser joints is located between the box and the auxiliary tubes.

14. The system according to claim 10, wherein:

the ring of each of the riser joints has an outer surface containing a plurality of axially extending recesses in axial alignment with the auxiliary tubes.

15. The system according to claim 10, further comprising:

a latch mounted to the box of each of the riser joints for retaining the ring in the locked position; and wherein the make-up tool engages and releases the latch when moving the ring from the locked to the unlocked position to disconnect two of the riser joints.

16. The riser system according to claim 10, further comprising:

a detent that exerts a force on the ring to releasably hold the ring in the unlocked position; and the make-up tool has sufficient force to overcome the force exerted by the detent when moving the ring to the locked position.

17. A method of making up first and second riser joints, each of the riser joints having a pipe with a longitudinal axis, the method comprising:

(a) providing a box on the first riser joint and mounting to the box at least one locking element and a ring in engagement with the locking element;

(b) providing a pin with an external grooved profile on the second riser joint;

(c) placing the pin in the box;

(d) supporting the first riser joint in an opening of a riser deploying floor and stabbing the second riser joint into engagement with the first riser joint;

(d) providing a make-up tool at the opening of the riser-deploying floor;

(e) moving an engaging member of the make-up tool inwardly from a retracted position into an engaged position with the ring; then (e) moving the engaging member and thereby the ring to cause the locking element to move from an unlocked to a locked position.

18. The method according to claim 17, wherein step (e) comprises moving the ring axially.

19. The method according to claim 17, wherein step (e) comprises rotating the ring.

20. The method according to claim 17, wherein:

step (e) further comprises latching the ring in the locked position and moving the engaging member to the retracted position.

* * * * *

UNITED STATES PATENT AND TRADEMARK OFFICE

CERTIFICATE OF CORRECTION

PATENT NO. : 7,337,848 B2
APPLICATION NO. : 11/508689
DATED : March 4, 2008
INVENTOR(S) : Fraser et al.

It is certified that error appears in the above-identified patent and that said Letters Patent is hereby corrected as shown below:

Column 1, line 55:

delete "moving the drilling rig"

Column 8, line 33:

delete "segments" and insert -- segment --

Signed and Sealed this

Eighth Day of July, 2008

JON W. DUDAS
*Director of the United States Patent and Trademark Office*